US006427469B1

(12) United States Patent
Daniel

(10) Patent No.: US 6,427,469 B1
(45) Date of Patent: Aug. 6, 2002

(54) REFRIGERANT CONDITIONING SYSTEM

(76) Inventor: Frank J. Daniel, 13 Fordham Court, Ballajura 6066 (AU)

( * ) Notice: Subject to any disclaimer, the term of this patent is extended or adjusted under 35 U.S.C. 154(b) by 0 days.

(21) Appl. No.: 09/802,548

(22) Filed: Mar. 9, 2001

(51) Int. Cl.[7] ..... F25B 45/00
(52) U.S. Cl. ..... 62/292; 62/85; 62/476
(58) Field of Search ..... 62/292, 85, 476

(56) References Cited

U.S. PATENT DOCUMENTS

| | | | | | |
|---|---|---|---|---|---|
| 4,476,688 | A | * | 10/1984 | Goddard | 62/149 |
| 4,606,363 | A | | 8/1986 | Scales | |
| 4,934,390 | A | | 6/1990 | Sapp | |
| 4,939,903 | A | * | 7/1990 | Goddard | 62/77 |
| 5,036,675 | A | * | 8/1991 | Anderson, Jr. | 62/85 |
| 5,040,382 | A | * | 8/1991 | Abraham | 62/470 |
| 5,168,720 | A | | 12/1992 | Keltner | |
| RE34,231 | E | * | 4/1993 | Anderson, Jr. | 62/85 |
| 5,218,831 | A | | 6/1993 | Keltner | |
| 5,379,605 | A | | 1/1995 | Outlaw et al. | |
| 5,415,003 | A | * | 5/1995 | Bartva et al. | 62/85 |
| 5,535,596 | A | * | 7/1996 | Todack | 62/85 |
| D377,179 | S | | 1/1997 | Sundheim et al. | |
| 5,617,731 | A | * | 4/1997 | Scaringe | 62/149 |
| 5,647,961 | A | * | 7/1997 | Lofland | 203/2 |
| 6,247,325 | B1 | * | 6/2001 | Muston et al. | 62/292 |

* cited by examiner

*Primary Examiner*—William C. Doerrler
*Assistant Examiner*—Mark S. Shulman

(57) ABSTRACT

A refrigerant conditioning system for cleansing debris and lubricants from refrigerants. The refrigerant conditioning system includes an housing; a refrigerant inlet assembly designed for interfacing with a cooling unit to be serviced; a filter assembly environmentally coupled to the refrigerant inlet assembly; a compressor/condenser assembly which is environmentally coupled to the filter assembly, the compressor/condenser assembly is positioned within the housing, the compressor/condenser assembly is for returning the coolant to a liquid state and expelling the coolant from the refrigerant condition system back into the cooling unit being serviced; and an refrigerant outlet assembly designed for interfacing with a refrigerant input of a cooling unit to be serviced, the refrigerant outlet assembly is environmentally coupled to the compressor/condenser assembly such that when the refrigerant inlet and outlet assemblies are coupled to the cooling unit being serviced a closed system is established for the flow and conditioning of the refrigerant.

12 Claims, 3 Drawing Sheets

REFRIGERANT CONDITIONING SYSTEM

BACKGROUND OF THE INVENTION

1. Field of the Invention

The present invention relates to refrigerant recovery systems and more particularly pertains to a new refrigerant conditioning system for cleansing debris and lubricants from refrigerants.

2. Description of the Prior Art

The use of refrigerant recovery systems is known in the prior art. More specifically, refrigerant recovery systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,606,363; 5,379,605; 5,218,831; 5,168,720; 4,934,390; and Des. 377,179.

While these devices fulfill their respective, particular objectives and requirements, the aforementioned patents do not disclose a new refrigerant conditioning system. The inventive device includes an housing with four walls, a top, and a bottom defining an interior space; a refrigerant inlet assembly designed for interfacing with a cooling unit to be serviced; a filter assembly environmentally coupled to the refrigerant inlet assembly such that a coolant flowing through the refrigerant inlet assembly flows into the filter assembly; a compressor/condenser assembly which is environmentally coupled to the filter assembly such that the coolant flows from the filter assembly into the compressor/condenser assembly, the compressor/condenser assembly is positioned within the housing, the compressor/condenser assembly is for returning the coolant to a liquid state and expelling the coolant from the refrigerant condition system back into the cooling unit being serviced; and an refrigerant outlet assembly designed for interfacing with a refrigerant input of a cooling unit to be serviced, the refrigerant outlet assembly is environmentally coupled to the compressor/condenser assembly such that when the refrigerant inlet assembly and the refrigerant outlet assembly are coupled to the cooling unit being serviced a closed system is established for the flow and conditioning of the refrigerant.

In these respects, the refrigerant conditioning system according to the present invention substantially departs from the conventional concepts and designs of the prior art, and in so doing provides an apparatus primarily developed for the purpose of cleansing debris and lubricants from refrigerants.

SUMMARY OF THE INVENTION

In view of the foregoing disadvantages inherent in the known types of refrigerant recovery systems now present in the prior art, the present invention provides a new refrigerant conditioning system construction wherein the same can be utilized for cleansing debris an d lubricants from refrigerants.

The general purpose of the present invention, which will be described subsequently in greater detail, is to provide a new refrigerant conditioning system apparatus and method which has many of the advantages of the refrigerant recovery systems mentioned heretofore and many novel features that result in a new refrigerant conditioning system which is not anticipated, rendered obvious, suggested, or even implied by any of the prior art refrigerant recovery systems, either alone or in any combination thereof.

To attain this, the present invention generally comprises an housing with four walls, a top, and a bottom defining an interior space; a refrigerant inlet assembly designed for interfacing with a cooling unit to be serviced; a filter assembly environmentally coupled to the refrigerant inlet assembly such that a coolant flowing through the refrigerant inlet assembly flows into the filter assembly; a compressor/condenser assembly which is environmentally coupled to the filter assembly such that the coolant flows from the filter assembly into the compressor/condenser assembly, the compressor/condenser assembly is positioned within the housing, the compressor/condenser assembly is for returning the coolant to a liquid state and expelling the coolant from the refrigerant condition system back into the cooling unit being serviced; and an refrigerant outlet assembly designed for interfacing with a refrigerant input of a cooling unit to be serviced, the refrigerant outlet assembly is environmentally coupled to the compressor/condenser assembly such that when the refrigerant inlet assembly and the refrigerant outlet assembly are coupled to the cooling unit being serviced a closed system is established for the flow and conditioning of the refrigerant.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new refrigerant conditioning system apparatus and method which has many of the advantages of the refrigerant recovery systems mentioned heretofore and many novel features that result in a new refrigerant conditioning system which is not anticipated, rendered obvious, suggested, or even implied by any of the prior art refrigerant recovery systems, either alone or in any combination thereof.

It is another object of the present invention to provide a new refrigerant conditioning system which may be easily and efficiently manufactured and marketed.

It is a further object of the present invention to provide a new refrigerant conditioning system which is of a durable and reliable construction.

An even further object of the present invention is to provide a new refrigerant conditioning system which is susceptible of a low cost of manufacture with regard to both materials and labor, and which accordingly is then susceptible of low prices of sale to the consuming public, thereby making such refrigerant conditioning system economically available to the buying public.

Still yet another object of the present invention is to provide a new refrigerant conditioning system which provides in the apparatuses and methods of the prior art some of the advantages thereof, while simultaneously overcoming some of the disadvantages normally associated therewith.

Still another object of the present invention is to provide a new refrigerant conditioning system for cleansing debris and lubricants from refrigerants.

Yet another object of the present invention is to provide a new refrigerant conditioning system which includes an housing with four walls, a top, and a bottom defining an interior space; a refrigerant inlet assembly designed for interfacing with a cooling unit to be serviced; a filter assembly environmentally coupled to the refrigerant inlet assembly such that a coolant flowing through the refrigerant inlet assembly flows into the filter assembly; a compressor/condenser assembly which is environmentally coupled to the filter assembly such that the coolant flows from the filter assembly into the compressor/condenser assembly, the compressor/condenser assembly is positioned within the housing, the compressor/condenser assembly is for returning the coolant to a liquid state and expelling the coolant from the refrigerant condition system back into the cooling unit being serviced; and an refrigerant outlet assembly designed for interfacing with a refrigerant input of a cooling unit to be serviced, the refrigerant outlet assembly is environmentally coupled to the compressor/condenser assembly such that when the refrigerant inlet assembly and the refrigerant outlet assembly are coupled to the cooling unit being serviced a closed system is established for the flow and conditioning of the refrigerant.

Still yet another object of the present invention is to provide a new refrigerant conditioning system that is fully self contained.

Even still another object of the present invention is to provide a new refrigerant conditioning system that lightweight and highly transportable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
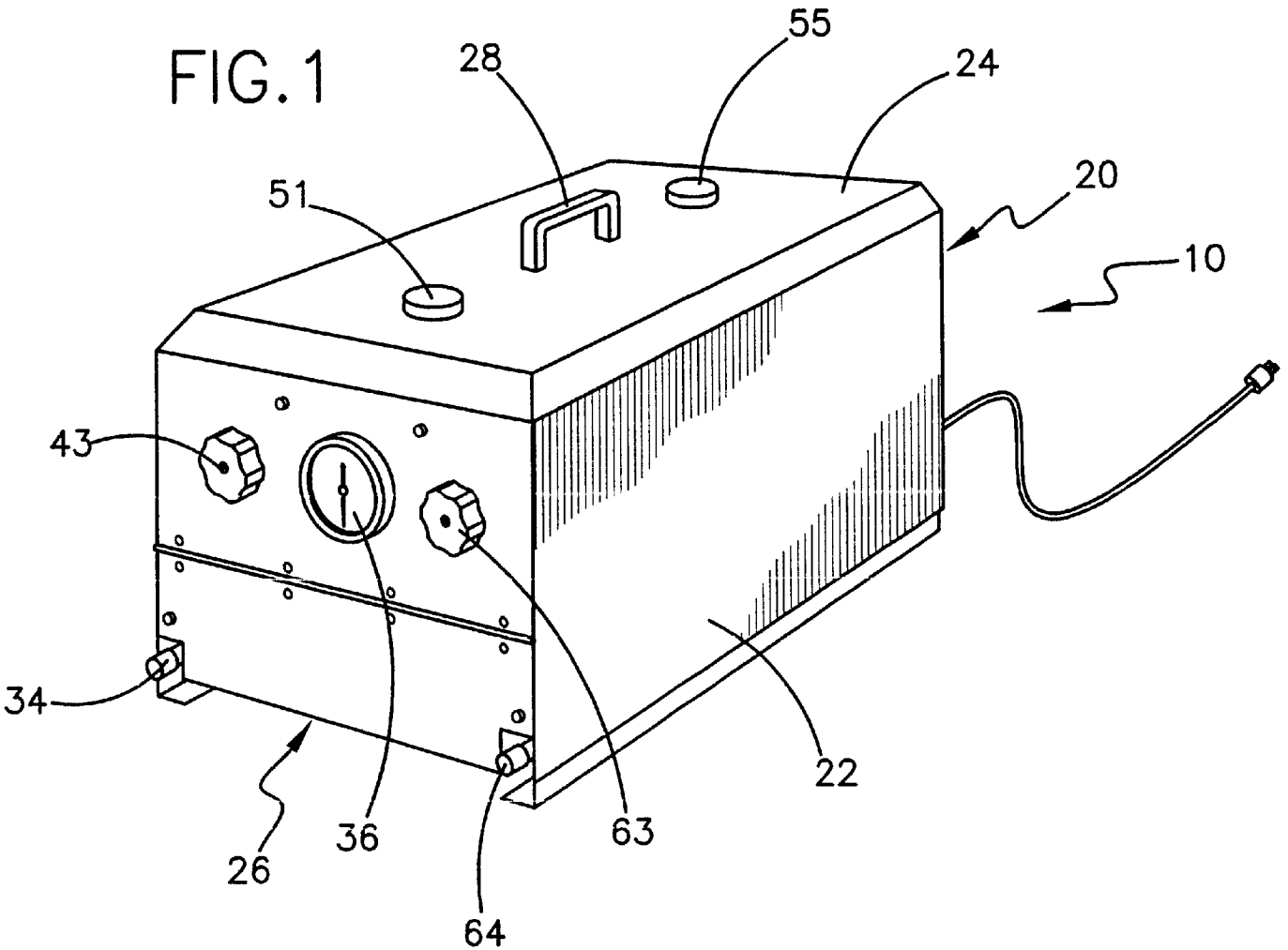
FIG. 1 is a schematic perspective view of a new refrigerant conditioning system according to the present invention.
Figure 2:
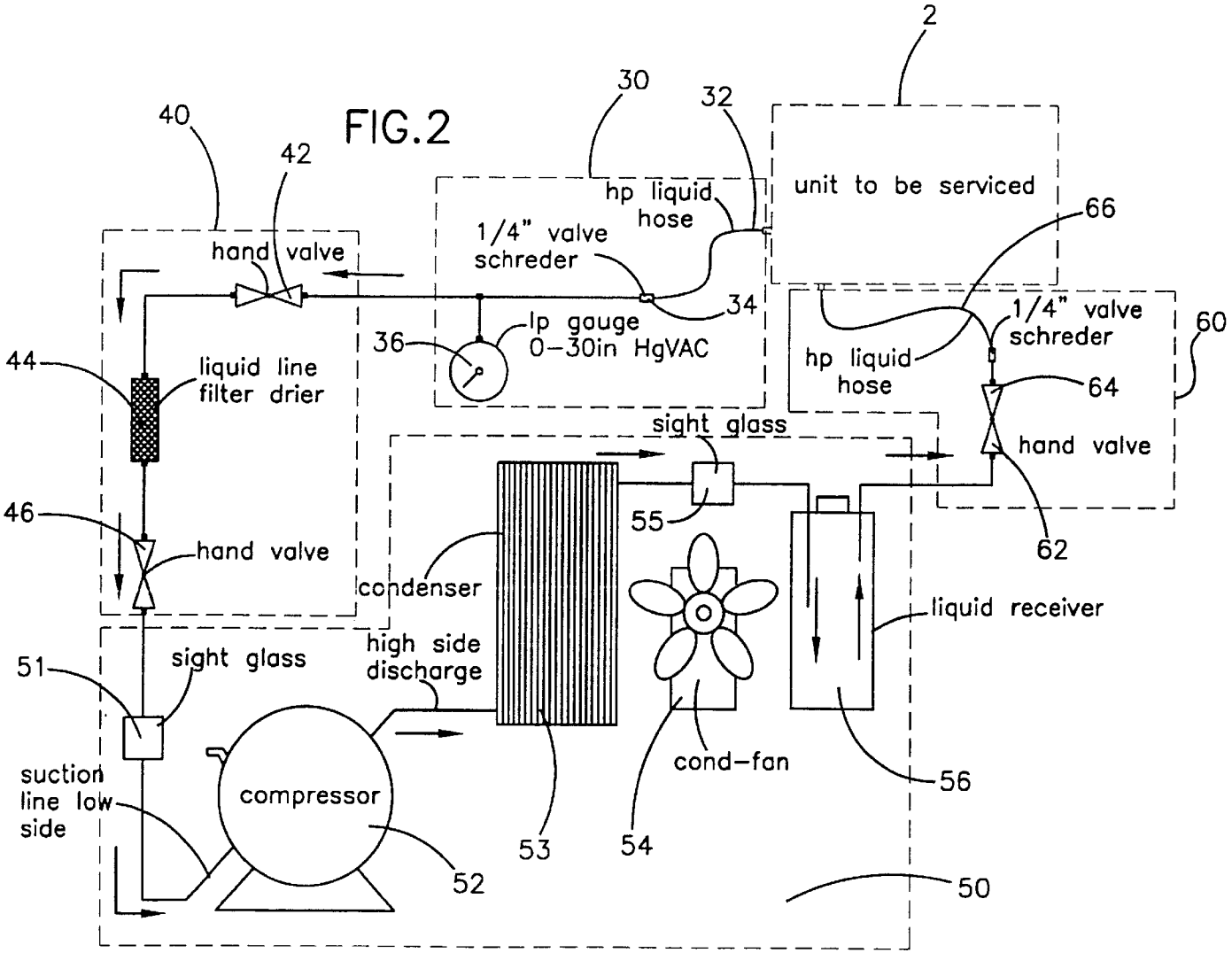
FIG. 2 is a schematic functional flow block diagram view of the present invention.
Figure 3:
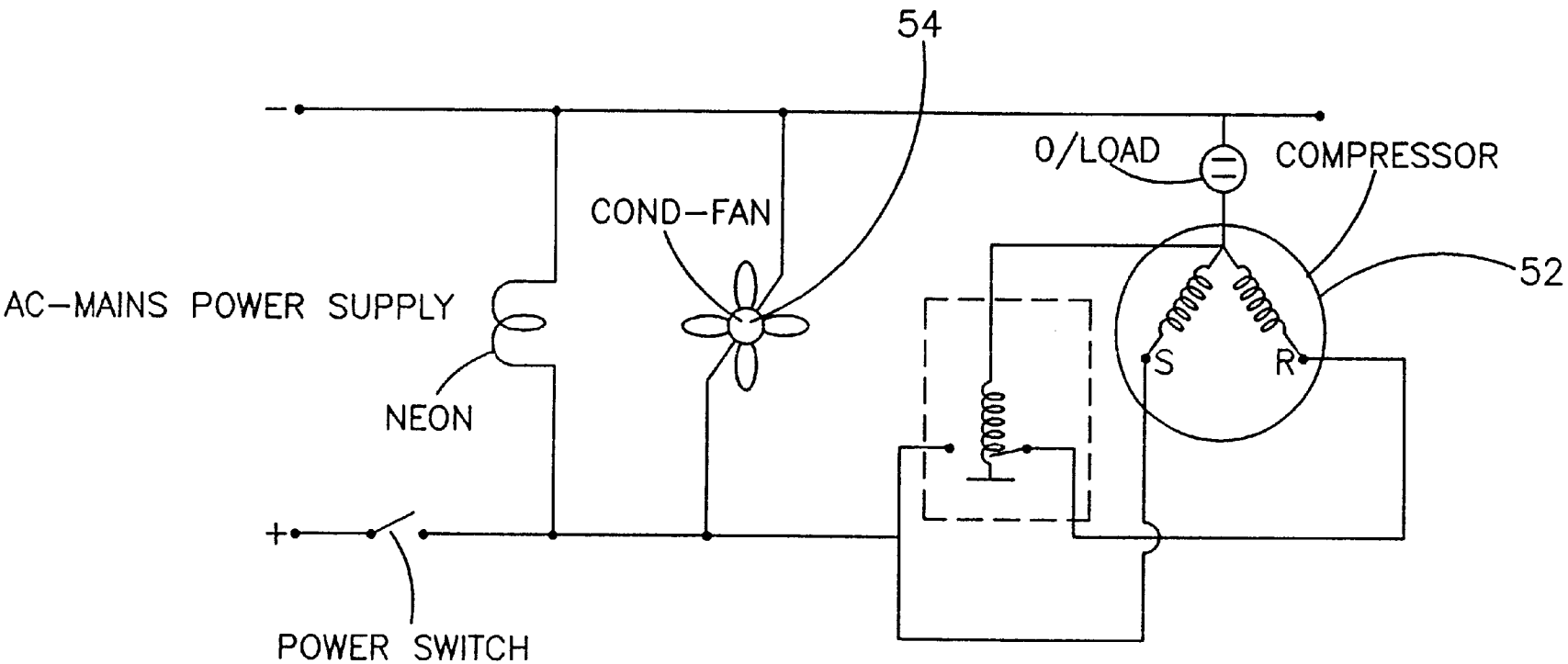
FIG. 3 is a schematic electrical connectivity view of the present invention.

With reference now to the drawings, and in particular to FIGS. 1 through 3 thereof, a new refrigerant conditioning system embodying the principles and concepts of the present invention and generally designated by the reference numeral 10 will be described.

As best illustrated in FIGS. 1 through 3, the refrigerant conditioning system 10 generally comprises an housing 20, a refrigerant inlet assembly 30, a filter assembly 40, a compressor/condenser assembly 50, and a refrigerant outlet assembly 60.

The housing 20 has four side walls 22, a top 24 and a bottom 26 which define an interior space.

The refrigerant inlet assembly 30 is designed for interfacing with a cooling unit to be serviced 2.

The filter assembly 40 is environmentally coupled to the refrigerant inlet assembly 30 such that a coolant flowing through the refrigerant inlet assembly flows 30 into the filter assembly 40.

The compressor/condenser assembly 50 is environmentally coupled to the filter assembly 40 such that the coolant flows from the filter assembly 40 into the compressor/condenser assembly 50. The compressor/condenser assembly 50 is positioned within the housing 20. The compressor/condenser assembly 50 is for returning the coolant to a liquid state and expelling the coolant from the refrigerant condition system 10 back into the cooling unit 2 being serviced.

The refrigerant outlet assembly 60 is designed for interfacing with a refrigerant input of a cooling unit 2 to be serviced. The refrigerant outlet assembly 60 is environmentally coupled to the compressor/condenser assembly 50 such that when the refrigerant inlet assembly 30 and the refrigerant outlet assembly 60 are coupled to the cooling unit 2 being serviced a closed system is established for the flow and conditioning of the refrigerant.

The refrigerant inlet assembly 30 further comprises a high pressure liquid hose member 32, a schreder valve member 34, and a pressure gauge 36.

The high pressure liquid hose member 32 includes a first end and a second end. The first end of the high pressure liquid hose member 32 is removably couplable to the cooling unit 2 to be service. The high pressure liquid hose member 32 is for facilitating the flow of refrigerant from the cooling unit 2 into the refrigerant conditioning system 10.

The schreder valve member 34 is positioned on a face of a side wall 22 of the housing 20. The schreder valve member 34 is for maintaining a closed system when the high pressure liquid hose member 32 is not connected to the schreder valve member 34 and for environmentally coupling the refrigerant conditioning system 10 to the cooling unit 2 when the second end of the high pressure liquid hose member 32 is coupled to the schreder valve member 34.

The pressure gauge 36 is operationally coupled to the schreder valve 34 and designed for monitoring the input pressure from the cooling unit 2 to the refrigerant conditioning system 10.

In an embodiment the schreder valve member 34 is a ¼ inch schreder valve.

In an further embodiment the pressure gauge member 36 has an operational range of 0–30 inches of mercury.

The filter assembly 40 further comprises a first 42 and second hand valve 46 and a filter member 44.

The first hand valve 42 is environmentally coupled to the refrigerant inlet assembly 30. The first hand valve 42 includes a valve portion and a handle portion 43. The handle portion 43 extends from a side wall 22 of the housing 20 for facilitating the opening and closing of the first hand valve 42. The valve portion is positioned substantially within the housing 20.

The filter member 44 is coupled to the first hand valve 42. The filter member 44 is designed for removing particulate materials and other contaminants from the refrigerant. The filter member 44 is environmentally coupled to the first hand valve 42.

The second hand valve 46 is positioned such that a handle portion of the second hand valve 46 extends from the bottom 26 of the housing 20. The second hand valve 46 can be closed to maintain a closed system when the filter member 44 is being replaced. The second hand valve 46 is normally left open during operation. The second hand valve 46 is environmentally coupled to the filter member 44.

The compressor/condenser 50 assembly further comprises a compressor 52, a condenser 53, a condenser fan 54, a liquid receiver 56, and a first 51 and second sight glass 55.

The compressor 52 is environmentally coupled to the filter assembly 40 such that refrigerant flowing from the filter assembly 40 flows into the compressor 52. The compressor 52 is for forcing the refrigerant out of the refrigerant conditioning system 10. The compressor 52 is positioned within the housing 20.

The condenser 53 is environmentally coupled to the compressor 52 such that refrigerant flowing from the compressor 52 flows into the condenser 53. The condenser 53 is designed for converting the refrigerant into a liquid. The condenser 53 is positioned within the housing 20.

The condenser fan 54 is positioned substantially within the housing 20. The housing 20 has an opening adjacent to the condenser fan 54 for facilitating the flow of air over a surface of the condenser 53 for heat transfer.

The liquid receiver 56 is environmentally coupled to the condenser 53 such that refrigerant flowing from the condenser 53 flows into the liquid receiver 56. The liquid receiver 56 is a storage tank for the refrigerant. The liquid receiver 56 is positioned within the housing 20.

The first sight glass 51 is operationally coupled between the filter assembly 40 and the compressor 52. The first sight glass 51 is for providing a visual indication of refrigerant gas and liquid flow. The first sight glass 51 is positioned such that the first sight glass 51 is visible from the top wall 24 of the housing 20.

The second sight glass 55 is operationally coupled between the condenser 53 and the liquid receiver 56. The second sight glass 55 is for providing a visual indication of refrigerant gas and liquid flow. The second sight glass 55 is positioned such that the second sight glass 55 is visible from the top wall 24 of the housing 20.

The refrigerant outlet assembly 60 further comprises a second high pressure liquid hose member 66, a second schreder valve member 64, and a third hand valve 63.

The second high pressure liquid hose member 66 includes a first end and a second end. The first end of the second high pressure liquid hose member 66 is removably couplable to the cooling unit 2 to be serviced. The second high pressure liquid hose member 66 is for facilitating the flow of refrigerant from the refrigerant conditioning system 10 back into the cooling unit 2 to be serviced.

The second schreder valve member 64 is positioned on a face of a side wall 22 of the housing 20. The second schreder valve member 64 is for maintaining a closed system when the second high pressure liquid hose member 66 is not connected to the second schreder valve member 64 and for environmentally coupling the refrigerant conditioning system 10 to the cooling unit 2 when the second end of the second high pressure liquid hose member 66 is coupled to the second schreder valve member 64. The second schreder valve member 64 is environmentally coupled to the compressor/condenser assembly 50.

The third hand valve 62 is environmentally coupled between the compressor/condenser assembly 50 and the second schreder valve 64. The third hand valve 62 has a valve portion and a handle portion 63. The handle portion 63 extends from a side wall 22 of the housing 20 for facilitating the opening and closing of the third hand valve 62. The valve portion is positioned substantially within the housing 20.

In an embodiment the second schreder valve 64 member comprises a ¼ inch schreder valve.

The housing 20 includes a handle 28, which is positioned on the top wall 24 of the housing 20. The handle 28 is for facilitating transportation of the refrigerant conditioning system 10.

In use, the high pressure liquid hose member is coupled to the refrigerant outlet of the cooling unit to be serviced. The second high pressure liquid hose member is connected to the refrigerant inlet of the cooling unit to be serviced. The first and third hand valves are opened and the refrigerant conditioning system is powered on. The system is run until the refrigerant has been fully conditioned. The system is then powered down, the first and third hand valves are closed, and the two high pressure liquid hose members are disconnected from the cooling unit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. and accordingly, all suitable modifications and equivalents may be resorted to, falling within the scope of the invention.

I claim:

1. A refrigerant conditioning system for removing debris and contaminants from refrigerants comprising:

a housing having four walls, a top and a bottom defining an interior space;

a refrigerant inlet assembly adapted for interfacing with a cooling unit to be serviced;

a filter assembly environmentally coupled to said refrigerant inlet assembly such that a coolant flowing through said refrigerant inlet assembly flows into said filter assembly;

a compressor/condenser assembly environmentally coupled to said filter assembly such that the coolant flows from said filter assembly into said compressor/condenser assembly, said compressor/condenser assembly being positioned within said housing, said compressor/condenser assembly being for returning the coolant to a liquid state and expelling the coolant from the refrigerant condition system back into the cooling unit being serviced;

an refrigerant outlet assembly adapted for interfacing with a refrigerant input of a cooling unit to be serviced, said refrigerant outlet assembly being environmentally coupled to said compressor/condenser assembly such that when said refrigerant inlet assembly and said refrigerant outlet assembly are coupled to the cooling unit being serviced a closed system is established for the flow and conditioning of the refrigerant;

wherein said refrigerant inlet system further comprises:

a high pressure liquid hose member having a first end and a second end, said first end of said high pressure liquid hose member being removably couplable to the cooling unit to be service, said high pressure liquid hose member being for facilitating the flow of refrigerant from the cooling unit into said refrigerant conditioning system;

a schreder valve member positioned on a face of a side wall of said housing, said schreder valve member being for maintaining a closed system when said high pressure liquid hose member is not connected to said schreder valve member and for environmentally coupling said refrigerant conditioning system to the cooling unit when said second end of said high pressure liquid hose member is coupled to said schreder valve member; and a pressure gauge operationally coupled to said schreder valve and adapted for monitoring the input pressure from the cooling unit to said refrigerant conditioning system.

2. The refrigerant conditioning system of claim 1, wherein said schreder valve member comprises a ¼ inch schreder valve.

3. The refrigerant conditioning system of claim 1, wherein said pressure gauge member has an operational range of 0–30 inches of mercury.

4. The refrigerant conditioning system of claim 1, wherein said filter assembly further comprises:

a first hand valve environmentally coupled to said refrigerant inlet assembly, said hand valve having a valve portion and a handle portion, said handle portion extending from a side wall of said housing for facilitating the opening and closing of said first hand valve, said valve portion being positioned substantially within said housing, a filter member coupled to said first hand valve, said filter member being adapted for removing particulate materials and other contaminants from the refrigerant, said filter member being environmentally coupled to said first hand valve; and a second hand valve positioned such that a handle portion of said second hand valve extends from said bottom of said housing, said second hand valve being closeable to maintain a closed system when said filter member is being replaced, said second hand valve being normally left open during operation, said second hand valve being environmentally coupled to said filter member.

5. The refrigerant conditioning system of claim 1, wherein said compressor/condenser assembly further comprises:

a compressor environmentally coupled to said filter assembly such that refrigerant flowing from said filter assembly flows into said compressor, said compressor being for forcing said refrigerant out of said refrigerant conditioning system, said compressor being positioned within said housing;

a condenser environmentally coupled to said compressor such that refrigerant flowing from said compressor flows into said condenser, said condenser being adapted for converting the refrigerant into a liquid, said condenser being positioned within said housing.

6. The refrigerant conditioning system of claim 5, wherein said compressor/condenser assembly further comprises a condenser fan positioned substantially within said housing, said housing having an opening adjacent to said condenser fan for facilitating the flow of air over a surface of said condenser for heat transfer.

7. The refrigerant conditioning system of claim 5, wherein said compressor/condenser assembly further comprises a liquid receiver environmentally coupled to said condenser such that refrigerant flowing from said condenser flows into said liquid receiver, said liquid receiver being a storage tank for the refrigerant, said liquid receiver being positioned within said housing.

8. The refrigerant conditioning system of claim 7, wherein said compressor/condenser assembly further comprises:

a first and second sight glass, said first sight glass being operationally coupled between said filter assembly and said compressor, said first sight glass being for providing a visual indication of refrigerant gas and liquid flow, said first sight glass being positioned such that said first sight glass is visible from said top wall of said housing;

said second sight glass being operationally coupled between said condenser and said liquid receiver, said second sight glass being for providing a visual indication of refrigerant gas and liquid flow, said second sight glass being positioned such that said second sight glass is visible from said top wall of said housing.

9. The refrigerant conditioning system of claim 1, wherein said refrigerant outlet assembly further comprises:

a second high pressure liquid hose member having a first end and a second end, said first end of said second high pressure liquid hose member being removably couplable to the cooling unit to be service, said second high pressure liquid hose member being for facilitating the flow of refrigerant from said refrigerant conditioning system back into the cooling unit to be serviced;

a second schreder valve member positioned on a face of a side wall of said housing, said second schreder valve member being for maintaining a closed system when said second high pressure liquid hose member is not connected to said second schreder valve member and for environmentally coupling said refrigerant conditioning system to the cooling unit when said second end of said second high pressure liquid hose member is coupled to said second schreder valve member, said second schreder valve member being environmentally coupled to said compressor/condenser assembly; and a third hand valve environmentally coupled between said compressor/condenser assembly and said second schreder valve, said third hand valve having a valve portion and a handle portion, said handle portion extending from a side wall of said housing for facilitating the opening and closing of said third hand valve, said valve portion being positioned substantially within said housing.

10. The refrigerant conditioning system of claim 9, wherein said second schreder valve member comprises a ¼ inch schreder valve.

11. The refrigerant conditioning system of claim 1, wherein said housing further comprises a handle positioned on said top wall of said housing, said handle being for facilitating transportation of said refrigerant conditioning system.

12. A refrigerant conditioning system for removing debris and contaminants from refrigerants comprising:

a housing having four walls, a top and a bottom defining an interior space;

a refrigerant inlet assembly adapted for interfacing with a cooling unit to be serviced;

a filter assembly environmentally coupled to said refrigerant inlet assembly such that a coolant flowing through said refrigerant inlet assembly flows into said filter assembly;

a compressor/condenser assembly environmentally coupled to said filter assembly such that the coolant flows from said filter assembly into said compressor/condenser assembly, said compressor/condenser assembly being positioned within said housing, said compressor/condenser assembly being for returning the coolant to a liquid state and expelling the coolant from the refrigerant condition system back into the cooling unit being serviced;

an refrigerant outlet assembly adapted for interfacing with a refrigerant input of a cooling unit to be serviced, said refrigerant outlet assembly being environmentally coupled to said compressor/condenser assembly such that when said refrigerant inlet assembly and said refrigerant outlet assembly are coupled to the cooling unit being serviced a closed system is established for the flow and conditioning of the refrigerant;

said refrigerant inlet system further comprises:

a high pressure liquid hose member having a first end and a second end, said first end of said high pressure liquid hose member being removably couplable to the cooling unit to be service, said high pressure liquid hose member being for facilitating the flow of refrigerant from the cooling unit into said refrigerant conditioning system;

a schreder valve member positioned on a face of a side wall of said housing, said schreder valve member being for maintaining a closed system when said high pressure liquid hose member is not connected to said schreder valve member and for environmentally coupling said refrigerant conditioning system to the cooling unit when said second end of said high pressure liquid hose member is coupled to said schreder valve member; and a pressure gauge operationally coupled to said schreder valve and adapted for monitoring the input pressure from the cooling unit to said refrigerant conditioning system;

wherein said schreder valve member comprises a ¼ inch schreder valve;

wherein said pressure gauge member has an operational range of 0–30 inches of mercury;

said filter assembly further comprises:

a first hand valve environmentally coupled to said refrigerant inlet assembly, said hand valve having a valve portion and a handle portion, said handle portion extending from a side wall of said housing for facilitating the opening and closing of said first hand valve, said valve portion being positioned substantially within said housing;

a filter member coupled to said first hand valve, said filter member being adapted for removing particulate materials and other contaminants from the refrigerant, said filter member being environmentally coupled to said first hand valve;

a second hand valve positioned such that a handle portion of said second hand valve extends from said bottom of said housing, said second hand valve being closeable to maintain a closed system when said filter member is being replaced, said second hand valve being normally left open during operation, said second hand valve being environmentally coupled to said filter member;

said compressor/condenser assembly further comprises:

a compressor environmentally coupled to said filter assembly such that refrigerant flowing from said filter assembly flows into said compressor said compressor being for forcing said refrigerant out of said refrigerant conditioning system, said compressor being positioned within said housing;

a condenser environmentally coupled to said compressor such that refrigerant flowing from said compressor flows into said condenser, said condenser being adapted for converting the refrigerant into a liquid, said condenser being positioned within said housing;

a condenser fan positioned substantially within said housing, said housing having an opening adjacent to said condenser fan for facilitating the flow of air over a surface of said condenser for heat transfer;

a liquid receiver environmentally coupled to said condenser such that refrigerant flowing from said condenser flows into said liquid receiver, said liquid receiver being a storage tank for the refrigerant, said liquid receiver being positioned within said housing;

a first and second sight glass, said first sight glass being operationally coupled between said filter assembly and said compressor, said first sight glass being for providing a visual indication of refrigerant gas and liquid flow, said first sight glass being positioned such that said first sight glass is visible from said top wall of said housing;

said second sight glass being operationally coupled between said condenser and said liquid receiver, said second sight glass being for providing a visual indication of refrigerant gas and liquid flow, said second sight glass being positioned such that said second sight glass is visible from said top wall of said housing;

said refrigerant outlet assembly further comprises:

a second high pressure liquid hose member having a first end and a second end, said first end of said second high pressure liquid hose member being removably couplable to the cooling unit to be service, said second high pressure liquid hose member being for facilitating the flow of refrigerant from said refrigerant conditioning system back into the cooling unit to be serviced;

a second schreder valve member positioned on a face of a side wall of said housing, said second schreder valve member being for maintaining a closed system when said second high pressure liquid hose member is not connected to said second schreder valve member and for environmentally coupling said refrigerant conditioning system to the cooling unit when said second end of said second high pressure liquid hose member is coupled to said second schreder valve member, said second schreder valve member being environmentally coupled to said compressor/condenser assembly;

a third hand valve environmentally coupled between said compressor/condenser assembly and said second schreder valve, said third hand valve having a valve portion and a handle portion, said handle portion extending from a side wall of said housing for facilitating the opening and closing of said third hand valve, said valve portion being positioned substantially within said housing;

said second schreder valve member comprises a ¼ inch schreder valve; and said housing further comprises a handle positioned on said top wall of said housing, said handle being for facilitating transportation of said refrigerant conditioning system.

* * * * *